US005121619A

United States Patent [19]

Martin

[11] Patent Number: 5,121,619

[45] Date of Patent: Jun. 16, 1992

[54] SPEED RELEASE MECHANISM FOR CYLINDER AND PLUG ASSEMBLY FOR USE WITH CABINET LOCKS

[75] Inventor: Frank J. Martin, Seattle, Wash.

[73] Assignee: Frank J. Martin Company, Seattle, Wash.

[21] Appl. No.: 738,788

[22] Filed: Jul. 31, 1991

[51] Int. Cl.[5] ..... E05B 9/04

[52] U.S. Cl. ..... 70/371; 70/369; 70/451

[58] Field of Search ..... 70/367-371, 70/451, 375

[56] References Cited

U.S. PATENT DOCUMENTS

| | | | |
|---|---|---|---|
| 337,093 | 3/1886 | Thistle | 70/368 X |
| 1,589,169 | 6/1926 | Hughes . | |
| 1,714,423 | 5/1929 | Jacobi | 70/368 |
| 1,914,639 | 6/1933 | Hurd | 70/369 |
| 2,039,244 | 4/1936 | Lowe | 70/368 |
| 2,058,895 | 10/1936 | Lowe | 70/368 X |
| 2,264,980 | 12/1941 | Jacobi . | |
| 2,268,511 | 12/1941 | Ledin . | |
| 2,307,106 | 1/1943 | Brush | 70/367 X |
| 2,391,832 | 12/1945 | Johnstone | 70/367 |
| 2,480,026 | 8/1949 | Jacobi . | |
| 2,739,473 | 3/1956 | Quillen | 70/375 X |
| 3,422,643 | 1/1969 | Foote . | |
| 3,527,071 | 9/1970 | Warnod . | |
| 3,589,152 | 6/1971 | Glass | 70/371 X |
| 3,753,361 | 8/1973 | Schlesterl . | |
| 3,919,867 | 11/1975 | Lipschutz et al. | 70/371 X |
| 4,222,253 | 9/1980 | Peitsmeier | 70/368 X |
| 4,397,167 | 8/1983 | Maiocco | 70/451 X |
| 4,548,061 | 10/1985 | Nilsson | 70/451 X |
| 4,669,288 | 6/1987 | Percebois et al. . | |
| 4,899,563 | 2/1990 | Martin | 70/451 X |
| 4,920,774 | 5/1990 | Martin | 70/451 X |

*Primary Examiner*—Rodney M. Lindsey
*Assistant Examiner*—Suzanne L. Dino
*Attorney, Agent, or Firm*—Michael J. Folise

[57] ABSTRACT

A cylinder and plug assembly is released by depression of a springloaded release button. The release button engages a radially directed aperture in a unitary shell. The radially directed aperture has longitudinally directed, diametrically opposed extensions which facilitate engagement and disengagement of the release button with the aperture.

12 Claims, 2 Drawing Sheets

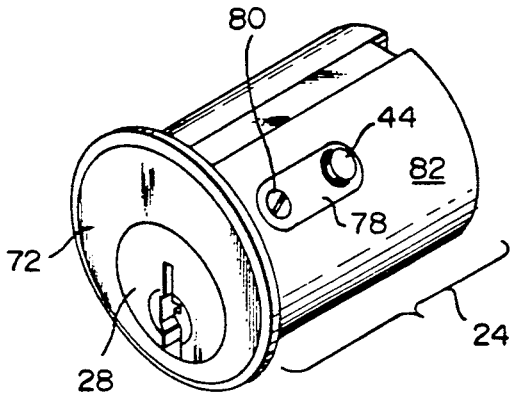
FIG. 5
FIG. 6
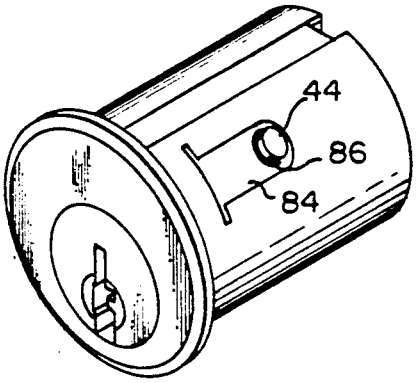
FIG. 7
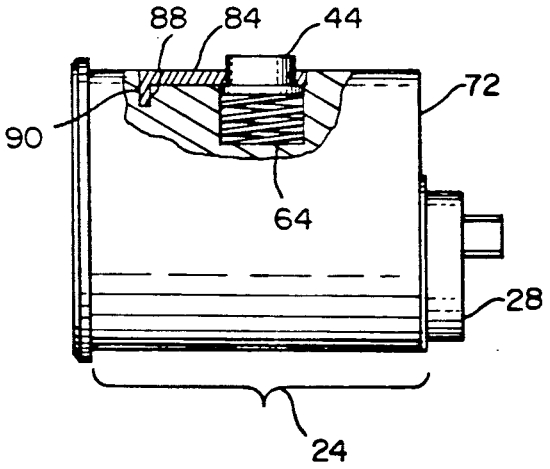

SPEED RELEASE MECHANISM FOR CYLINDER AND PLUG ASSEMBLY FOR USE WITH CABINET LOCKS

TECHNICAL FIELD

The invention relates to pin tumbler type cabinet door and drawer locks. More specifically, the invention relates to removable, re-keyable cylinder and plug assemblies for cabinet door and drawer locks and the like.

BACKGROUND OF THE INVENTION

Substantial progress has been made in the development of re-keyable cylinder and plug assemblies for cabinet locks, such as the technique described in my issued U.S. Pat. No. 4,920,774 titled SELF ALIGNING RE-KEYABLE PIN TUMBLER CABINET DOOR LOCK and my issued U.S. Pat. No. 4,899,563 titled RE-KEYABLE PIN TUMBLER DRAWER LOCK AND PIN TUMBLER CABINET DRAWER LOCK. In my previous '774 patent, the cylinder and plug assembly is forwardly removable merely by releasing a set screw with a conventional screwdriver. The cylinder and plug assembly may then be readily disassembled for replacement of the pins to re-key the lock. Upon reinsertion of the cylinder and plug assembly into the lock body, a guide mechanism insures that a threaded bore in the cylinder and plug assembly aligns with an aperture in the unitary lock shell so that the screw may be quickly reengaged. Prior to my self aligning, re-keyable pin tumbler cabinet door lock described in my U.S. Pat. No. 4,920,744 and my re-keyable cabinet and door lock described in my parent U.S. Pat. No. 4,899,563, the disclosures of which are incorporated herein by reference, cabinet and drawer locks employing releasable cylinder and plug assemblies generally required the use of special tools or complex assemblies which render re-keying of locks of this type economically unfeasible.

Although my above identified locks have been commercialized and have achieved substantial commercial success, the use of a screwdriver is nevertheless required to release the cylinder and plug assembly from the lock's unitary shell. Although screwdrivers are readily available, picking up a tool, using the tool and placing the tool down requires time which could otherwise be applied towards disassembly of the removed cylinder and plug assembly and towards replacement of the tumbler pins.

The theoretical application of a push button release to a cylinder and plug assembly would significantly reduce the time required to remove and reinsert a cylinder and plug assembly into my unitary shell lock body. In addition, a non-removable release button would avoid the possibility of losing the set screw on my above described locks.

The fundamental concept of applying a spring loaded release mechanism to a cylinder and plug assembly is well known. Devices of this type are disclosed in U.S. Pat. No. 1,914,639 to Hurd, U.S. Pat. Nos. 2,058,895 and 2,039,244 to Lowe and U.S. Pat. No. 3,527,071 to Warnod. In each of these devices however, complex machining steps and construction techniques are involved in production of the release mechanism. The expense involved in such machining and construction is generally unacceptable for cabinet door and drawer locks (which are relatively inexpensive applications). Hurd, for example employs has a non-springloaded, release button which reciprocates in a bore. The open end of the bore must be peened from the inside to prevent the release button from escaping from the bore. Such interior peening is relatively expensive and thus counterproductive to the development of an economical, re-keyable cabinet door or drawer lock. The mortice type lock shown in the Hurd '639 patent is a relatively expensive type of lock which can justify an expensive peening step.

The release buttons disclosed in the Lowe '895 patent require expensive milling steps to develop squared off bores in which springloaded release buttons having squared off sides reciprocate. The Lowe '895 device is intended for use in automobiles which justifies the relatively high manufacturing cost of providing squared off bores. Furthermore, other springloaded lock release devices such as those disclosed in U.S. Pat. No. 3,919,867 to Lipschutz et al., U.S. Pat. No. 337,093 to Thistle, and U.S. Pat. No. 2,039,244 to Lowe require the use of special tools to depress the release button. The use of special tools to effect re-keying renders universal re-keyability by locksmiths impractical.

Therefore a need exists for a re-keyable cabinet and drawer lock having a removable cylinder and plug assembly which can be released by a relatively inexpensive push button mechanism.

SUMMARY OF THE INVENTION

It is therefore an object of the present invention to provide a re-keyable cabinet and drawer lock having a removable cylinder and plug assembly which can be removed merely by depressing a release button.

It is further object of the present invention to achieve the above object in a structure which is relatively inexpensive to manufacture.

It is yet another object of the present invention to achieve the above objects in a structure which does not require the use of specialized tools.

The invention achieves these and other objects, the advantages of which will become apparent from the description which follows by providing a cabinet door or drawer lock having a unitary shell for housing a removable cylinder and plug assembly. This unitary shell structure allows the cylinder and plug assembly to be forwardly removable from an elongated cylindrical housing portion of the shell, by way of a radially directed release button which engages a substantially circular aperture in the cylindrical housing portion. The circular aperture has diametrically opposed, longitudinally directed aperture extensions. These extensions facilitate smooth engagement and disengagement of the release button with the circular aperture when the cylinder and plug assembly is removed and reinserted in the cylindrical housing portion. In addition, the aperture extensions facilitate depression of the release button with a thumb nail if a probe or other sharp implement is not available.

In one preferred embodiment of the invention, the release button is springloaded and has an enlarged diameter portion and a reduced diameter portion forming a shoulder therebetween. Stakes can be driven into the perimeter of the bore so as to deform a portion of the cylinder and plug assembly into the bore and thus restrict movement of the release button out of the bore. The lock can also be provided with an ejector spring which immediately ejects the cylinder and plug assembly from the unitary shell when the release button is depressed.

In alternate embodiments of the invention, the enlarged diameter portion of the release button can be retained within the cylinder and plug assembly by a plate which can be connected to the cylinder and plug assembly either by a screw or tab portion which resides within a slot in the cylinder and plug assembly in an interference fit.

BRIEF DESCRIPTION OF THE DRAWINGS

FIG. 5 is an enlarged, isometric view of a third embodiment of the invention.

FIG. 6 is an enlarged, isometric view of a fourth embodiment of the invention.

FIG. 7 is a side elevational view, partially cut away of the embodiment shown in FIG. 6.

BEST MODE FOR CARRYING OUT THE INVENTION

Figure 1:
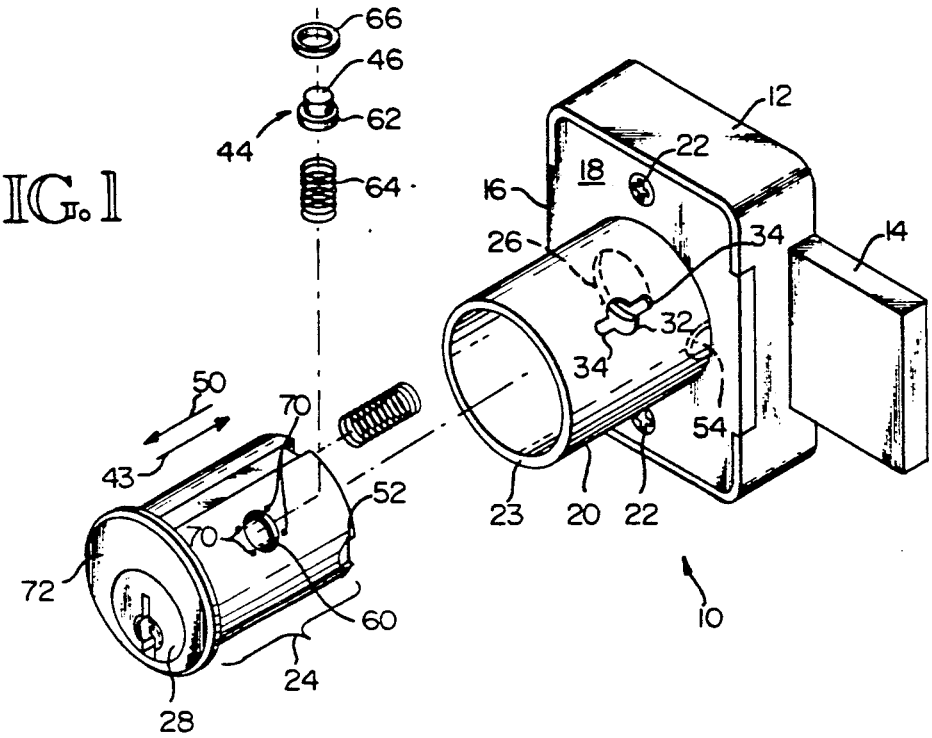
FIG. 1 is an exploded, isometric view of a drawer lock employing the general concept of the invention.

A cabinet lock, in accordance with the invention is generally indicated at reference numeral 10 in FIG. 1. Although the invention is shown in the drawings as applied to a cabinet lock, the concept generally embodied in the invention is applicable to drawer locks and sliding door locks as well.

The lock 10 has a bolt housing 12 for receiving and guiding a bolt 14 for reciprocal motion into and out of the bolt housing. The lock also has a unitary shell 16 having a backing plate portion 18 for covering the bolt housing and an elongated, longitudinally directed cylindrical housing portion 20 for receiving a cylinder, and plug assembly. Screws 22 secure the unitary shell 16 to the bolt housing 12.

The cylindrical housing portion 20 has an open front end 23 for removably receiving a cylinder and plug assembly 24, and a smaller, off center aperture 26 which serves as a rotational bearing for a cam (not shown) which translates rotary motion of a plug 28 through a driver pin 30 to reciprocal motion of the bolt 14.

The cylinder and plug assembly 24 preferably provided with a rear, external longitudinally directed notch 52 having a curved forward end for engagement with a longitudinally directed projection 54 within the cylindrical housing portion of the unitary shell 16. Both the notch and the projection preferably have curved forward ends so that the cylinder and plug assembly is directed into the cylindrical housing portion with the release button 44 aligned with the aperture extensions 34 automatically. Upon proper alignment of the cylinder and plug assembly within the cylinder housing portion due to interaction of the notch projection, the release button is directed into engagement with the aperture 32 for engagement therewith.

The cylindrical housing portion also defines a radially directed aperture 32 having diametrically opposed, longitudinally directed aperture extensions 34. The aperture 32 is sized and positioned to flushly receive a reduced diameter portion 40 of a substantially cylindrical release button generally indicated at reference numeral 44 in FIG. 1. The top 46 of the release button is slightly spherical, so as to substantially match the curvature of the cylindrical housing 20. Nevertheless, the perimeter of the top would tend to catch against the edge of the aperture 32 unless the aperture extensions 34 were present in both the insertion 48 and releasing 50 directions. The reduced diameter portion 40 of the release button 44 has a height of approximately 0.060 inch to substantially match the same thickness of the cylindrical housing portion 20.

The cylinder and plug assembly 24 is provided with a substantially constant diameter bore 60 for reciprocally receiving an enlarged diameter portion 62 of the release button 44. A compression spring 64 is provided within the bore and beneath the release button to urge the release button in a radially outward direction so that the reduced diameter portion 40 engages the circular aperture 32 in the unitary shell 16, thus restricting the cylinder and plug assembly against both rotational and longitudinal motion with respect to the cylindrical housing portion 20.

Figure 2:
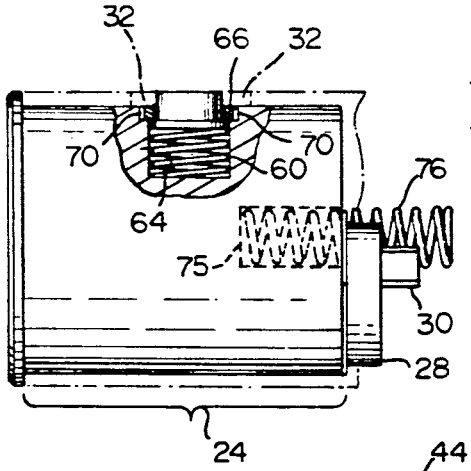
FIG. 2 is an enlarged, side elevational view of a cylinder and plug assembly employing a first embodiment of the invention.
Figure 4:
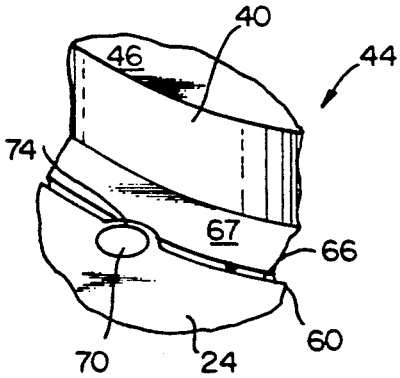
FIG. 4 is an enlarged, partial isometric view of a stake retaining a shoulder portion of the release button within the cylinder and plug assembly.

As best seen in FIG. 2, a bronze washer 66 having an outer diameter substantially equal to the diameter of the bore 60, and an inner diameter slightly larger than the diameter of the reduced diameter portion 40 is positioned around the reduced diameter portion and within the bore. The washer abuts against a shoulder 67 which is formed at a junction between the reduced and enlarged diameter portions of the release button 44. It has been discovered that the washer is best retained in the bore by driving four metal stakes 70 having a length of approximately 0.002 inch into the cylinder and plug assembly adjacent to the bore so that the edge of the bore is deformed and pressed against the washer as best seen in FIG. 4. The cylinder portion 72 of the cylinder and plug assembly 24 is preferably manufactured from a relatively malleable material, such as brass so that the material 74 adjacent to the perimeter of the bore deforms around the stake and compresses the washer. In this manner, the release button 44 does not exit the bore 60 after the cylinder and plug assembly has been released from the unitary shell 16.

The cylinder 72 of the cylinder and plug assembly is also provided with a rear, longitudinal bore 75 for receiving a stainless steel ejector spring 76. The ejector spring compresses when the cylinder and plug assembly 24 is received in the unitary shell. Upon depression of the release button 44 through the aperture 32, the cylinder and plug assembly 24 is immediately and substantially ejected from the cylindrical housing portion 20 in the direction 50.

Figure 3:
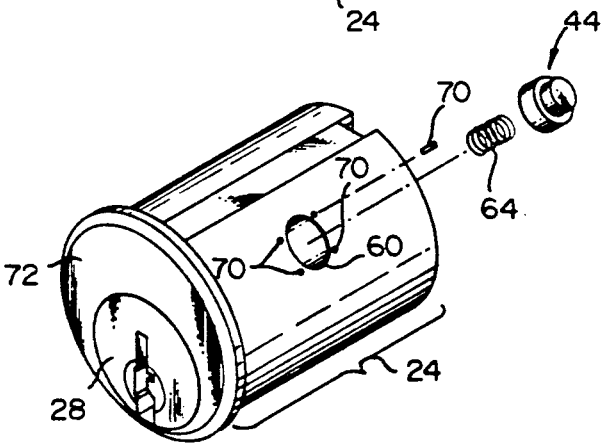
FIG. 3 is an exploded, isometric view of a second embodiment of the invention employing stakes to retain a release button in the cylinder and plug assembly.

An alternate embodiment of the invention is shown in FIG. 3, in which the release button 44 is retained within the bore 60 merely by stakes 70 without the use of the washer 66. It has been discovered that by peripherally positioning the stakes adjacent to the bore 60, the perimeter of the bore in the vicinity of the stakes is sufficiently deformed so as to protrude laterally into the bore and engage the shoulder 67 of the release button to prevent escape of the same from the bore.

Another alternate embodiment of the invention is shown in FIG. 5 in which the release button 44 is maintained in the bore 60 by a flushly fitting, substantially planer retention plate 78. The retention plate is secured to the cylinder 72 by a radially directed screw 80. The plate resides in a milled out area so as to be substantially flush with the exterior surface 82 of the cylinder portion 72.

FIG. 6 illustrates yet another alternate embodiment of the invention in which the release button 44 is retained against the bias of the compression spring 64 by a clip 84. The clip has an aperture 86 for passage therethrough of the reduced diameter portion 40 of the release button 44. The clip 84 also resides in a milled out area as does the plate 78 of FIG. 5 except, as shown in FIG. 7 the clip 84 has a downturned lip 88 which is positioned in a radial slot 90 in the cylinder portion 72 of the cylinder and plug assembly 24 in an interference fit. The clip is preferably manufactured from spring steel.

The construction techniques described above substantially simplify manufacture of the invention so as to render a push button release cylinder and assembly for a lock employing a unitary shell body commercially viable.

Upon reviewing this disclosure, those of ordinary skill in the art will envision other embodiments which employ the same general principals of the invention. Although these embodiments are not illustrated, the invention should not be limited to the embodiments described above, but should be determined in scope by the claims which follow.

I claim:

1. A quick release cylinder and plug assembly for cabinet door and drawer locks and the like, comprising:

a unitary shell defining a backing plate portion and an elongated cylindrical housing portion having an open end for removably receiving a cylinder and plug assembly, the cylindrical housing portion further defining a radially directed, substantially circular aperture having diametrically opposed, longitudinally directed aperture extensions, each extension having a width substantially less than the diameter of the circular aperture;

a re-keyable, tumbler type cylinder and plug assembly having a radially directed, spring loaded release button protruding therefrom and positioned for engagement with the substantially circular aperture in the unitary shell;

self ejecting means for ejecting the cylinder and plug assembly out of the cylindrical housing portion when the release button is depressed; and self alignment means for aligning the release button with the substantially circular aperture and the longitudinally directed aperture extensions as the cylinder and plug assembly is inserted into the open end, whereby the release button is automatically re-engaged with the circular aperture when the cylinder and plug assembly is fully inserted through the open end and whereby the cylinder and plug assembly is automatically ejected from the unitary shell when the release button is depressed.

2. The quick release cylinder and plug assembly of claim 1, wherein the release button has an enlarged diameter portion sized to be closely received in a substantially constant diameter radially directed bore in the cylinder and plug assembly, and a reduced diameter protruding portion forming a shoulder at a junction between the enlarged and reduced diameter portions.

3. The quick release cylinder and plug assembly of claim 2, wherein the cylinder and plug assembly is constructed from a substantially malleable material and wherein the bore is closely surrounded by a plurality of stakes driven into the cylinder and plug assembly adjacent to the bore so as to deform the malleable material laterally into the bore and above the shoulder of the release button to retain the release button within the bore.

4. The quick release cylinder and plug assembly of claim 3, wherein a washer is positioned between the shoulder and the stakes.

5. The quick release cylinder and plug assembly of claim 3, wherein the self-alignment means has a radially inwardly and longitudinally outwardly directed alignment lug within the cylindrical housing portion, and a cooperatively shaped alignment groove in an exterior surface of the cylinder and plug assembly.

6. The quick release cylinder and plug assembly of claim 2, wherein the cylinder and plug assembly has a milled out area therein adjacent to the release button and wherein the release button is retained in the bore by a flush plate connected to the cylinder and plug assembly and defining an aperture sized to pass the reduced diameter portion of the release button therethrough but not to pass the enlarged diameter portion therethrough.

7. The quick release cylinder and plug assembly of claim 6, wherein the flush plate is connected to the cylinder and plug assembly by a flush screw.

8. The quick release cylinder and plug assembly of claim 6, wherein the flush plate has a downturned lip thereon, wherein the cylinder and plug assembly has a radial slot therein, and wherein the lip is received in the slot in an interference fit.

9. A re-keyable cabinet door and drawer lock and the like, comprising:

a unitary shell defining a backing plate portion and an elongated cylindrical housing portion having an open end for removably receiving a cylinder and plug assembly, the cylindrical housing portion further defining a radially directed, substantially circular aperture having diametrically opposed, aperture extensions;

a re-keyable, tumbler type cylinder and plug assembly manufactured from a substantially malleable material and having a spring loaded release button reciprocally received in a substantially constant diameter radially directed bore, the release button having an enlarged diameter portion sized to be closely received in the bore, and a reduced diameter portion for protruding from the bore and positioned for engagement with the circular aperture in the unitary shell, the enlarged and reduced diameter portions forming a shoulder at a junction therebetween, the cylinder and plug assembly further having a plurality of stakes driven around a perimeter of the bore so as to deform the malleable material laterally into the bore and above the shoulder of the release button to retain the release button within the bore;

self ejecting means for ejecting the cylinder and plug assembly out of the cylindrical housing portion when the release button is depressed; and self alignment means for aligning the release button with the substantially circular aperture and the aperture extensions as the cylinder and plug assembly is inserted into the open end, whereby the release button is automatically re-engaged with the circular aperture when the cylinder and plug assembly is fully seated in the cylindrical housing portion and whereby the cylinder and plug assembly is automatically ejected from the unitary shell when the release button is depressed.

10. The lock of claim 9, wherein a washer is positioned between the shoulder and the stakes.

11. A method for retaining a spring loaded release button in a removable, re-keyable cylinder and plug assembly, comprising the steps of:

forming a radially directed bore having a substantially constant bore diameter in a cylinder and plug assembly manufactured from a substantially malleable material;

inserting a spring loaded release button having an enlarged diameter portion sized to be closely received in the bore, and a reduced diameter portion for protruding from the bore into the bore and depressing the button against the spring load; and driving a plurality of stakes around a perimeter of the bore so as to deform the malleable material laterally into the bore above the enlarged diameter portion of the release button to retain the release button within the bore.

12. The method of claim 11 wherein before the stake driving step and after the button inserting step an annular washer having an outer diameter approximately equal to the bore diameter and an inner diameter larger than the reduced diameter portion of the release button is inserted into the bore and around the reduced diameter potion so that after the staking step the washer is substantially flush with an outer surface of the cylinder and plug assembly.

* * * * *